US005081438A

United States Patent [19]

Nakahata et al.

[11] Patent Number: 5,081,438

[45] Date of Patent: Jan. 14, 1992

[54] THERMISTOR AND ITS PREPARATION

[75] Inventors: Hideaki Nakahata; Naoji Fujimori, both of Itami, Japan

[73] Assignee: Sumitomo Electric Industries, Ltd., Osaka, Japan

[21] Appl. No.: 506,191

[22] Filed: Apr. 9, 1990

[30] Foreign Application Priority Data

Apr. 11, 1989 [JP] Japan ..... 1-92663

[51] Int. Cl.[5] ..... H01C 7/10

[52] U.S. Cl. ..... 338/225 D; 29/612

[58] Field of Search ..... 338/225 D, 22 R; 437/918, 209, 165; 156/192.25; 29/612

[56] References Cited

U.S. PATENT DOCUMENTS

| | | |
|---|---|---|
| 3,148,161 | 9/1964 | Wentorf et al. . |
| 3,435,399 | 3/1969 | Gieliesse et al. . |
| 3,735,321 | 5/1973 | Bovenkerk . |
| 4,276,535 | 6/1981 | Mitsuyu et al. . |
| 4,359,372 | 11/1982 | Nagai et al. . |
| 4,434,188 | 2/1984 | Kamo et al. . |
| 4,467,309 | 8/1984 | Matsushita et al. . |
| 4,712,085 | 12/1987 | Miki et al. . |
| 4,768,011 | 8/1988 | Hattori et al. . |
| 4,806,900 | 2/1989 | Fujimori et al. . |

FOREIGN PATENT DOCUMENTS

| | | |
|---|---|---|
| 59-207651 | 11/1984 | Japan . |
| 59-208821 | 11/1984 | Japan . |
| 59-213126 | 12/1984 | Japan . |
| 63-184304 | 7/1988 | Japan . |
| 1-116480 | 5/1989 | Japan . |
| 7359998 | 8/1955 | United Kingdom . |

OTHER PUBLICATIONS

Matsumo, et al., "Vapor Deposition of Diamond Particles from Methane", Japanese Journal of Applied Physics, vol. 21, p. L183.

Vereschchagin, et al., "Thermister Made of P-Type Synthetic Diamond", Soviet Physics-Semiconductors, vol. 8, pp. 1581-1582.

*Primary Examiner*—Marvin M. Lateef

*Attorney, Agent, or Firm*—Cushman, Darby & Cushman

[57] ABSTRACT

A thermistor having a temperature detecting part which has a temperature sensing part made of a vapor phase deposited semiconductive diamond film, a metal electrode layer formed on one surface of the semiconductive diamond film, and at least one lead wire connected with the metal electrode layer provided that at least 50% of a total volume of the temperature sensing part and the metal electrode layer is made of the vapor phase deposited diamond.

9 Claims, 2 Drawing Sheets

THERMISTOR AND ITS PREPARATION

BACKGROUND OF THE INVENTION

1. Field of the Invention

The present invention relates to a thermistor having good thermal response and good heat resistance and its preparation.

2. Description of the Related Art

A thermistor is an electronic device which utilizes the change of resistance when the temperature changes, and is widely used as a temperature sensor and a compensator for an electronic circuit. The most generally used thermistor comprises a metal oxide and is used in the temperature range of 0° C. to 350° C. To satisfy the requirement for the thermistor which can be used at a higher temperature, the thermistor comprising SiC or $B_4C$ which can be used in the temperature range of 0° C. to 500° C. has been developed. As the thermistor which can be used at a further higher temperature, the thermistor comprising diamond which is chemically stable at a high temperature and can be used in the temperature range of 0° C. to 800° C. has been developed. Since diamond has a thermal conductivity of 20 W/cm·K which is the largest among all substances and a small specific heat of 0.50 J/g·K, the thermistor comprising diamond is expected to have a high thermal response speed. The diamond thermistor initially comprised single crystal diamond. Although this thermistor has a high thermal response speed, it is not widely used due to difficult control of the resistance and bad processability. Since a method of forming a diamond film by a vapor phase deposition was recently established, the diamond film grown on a substrate is used in the thermistor. Since the resistance of the diamond film can be easily controlled by doping an impurity during the vapor phase deposition of the diamond film and the processability of the film is better than that of the single crystal diamond, the thermistor which utilizes diamond formed by the vapor phase deposition has been developed as the thermistor which can be used in a wide temperature range (Japanese Patent Kokai Publication No. 184304/1988).

However, in the conventional diamond film thermistor, since a volume of a substrate is usually hundred to thousand times larger than that of the diamond film, thermal response in the substrate having the low thermal conductivity dominates that in the diamond film. The conventional thermistor has a problem that the property of the diamond is not effectively utilized. The thermistor in which natural single crystal diamond or single crystal diamond synthesized at an ultra high pressure is used as the substrate and in which the diamond film is epitaxially grown has high thermal response speed, but the single crystal diamond as the substrate is not economical.

SUMMARY OF THE INVENTION

An object of the present invention is to provide a thermistor which has good thermal response and good heat resistance and is economical.

This and other objects are achieved by a thermistor comprising a temperature detecting part that includes a temperature sensing part made of a vapor phase deposited semiconductive diamond film, a metal electrode layer formed on one surface of the semiconductive diamond film, at least one lead wire connected with the metal electrode layer and a substrate containing an insulative diamond film on a second surface of the semiconductive diamond film. The vapor phase deposited diamond constitutes at least 50% of a total volume of the temperature sensing part, the metal electrode layer and the substrate.

DETAILED DESCRIPTION OF THE INVENTION

Figure 1:
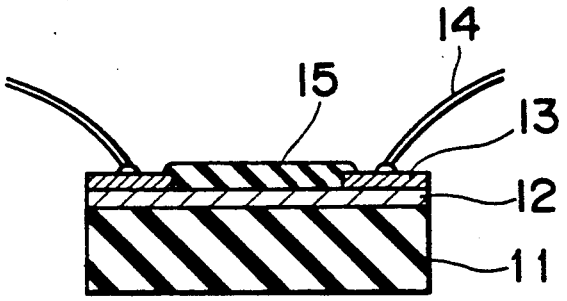
FIG. 1 and FIG. 2 are cross-sectional views of preferred embodiments of a thermistor of the present invention.

The temperature detecting part may further comprise at least one selected from the group consisting of a substrate on the other surface of the semiconductive diamond film, a protective film for protecting the semiconductive diamond film, a covering material for covering the thermistor, and an adhesive for connecting the lead wire with the electrode layer. 100% by volume of the temperature sensing part, 0 to 100% by volume of the substrate and 0 to 100% by volume of the protective film are made of the vapor phase deposited diamond wherein the vapor phase deposited diamond constitutes at least 50% of a total volume of the temperature sensing part, the metal electrode layer and the substrate.

The vapor phase deposited diamond is a diamond film formed by a vapor phase deposition and is usually polycrystal diamond. A diamond film constituting the temperature sensitive part is a semiconductive diamond film. A diamond film which may constitute at least a part of the optional substrate and at least a part of the optional protective film is an insulative diamond film. The whole of the substrate or the whole of the protective film is not necessarily the diamond. The metal electrode layer is an ohmic electrode formed on the semiconductive diamond film.

The thermistor of the present invention may have the protective film. The protective film may cover whole of the thermistor, or a part of the thermistor, for example, an exposed part of the diamond film.

The thermistor of the present invention can be prepared by forming the diamond film on a substrate (hereinafter referred to as "a substrate for growing the diamond film" so as to prevent confusing it with the substrate on the temperature sensing part) other than single crystal diamond by the vapor phase deposition, and then removing at least a part of the substrate for growing the diamond film.

The diamond film can be formed on the substrate for growing the diamond film by a vapor phase deposition from a feed gas. The method for forming the diamond film includes (1) a method comprising activating the feed gas by effecting a discharge in a direct or alternating electric field, (2) a method comprising activating the feed gas by heating a thermion emission material, (3) a method comprising bombarding ions on a surface on which the diamond is grown, (4) a method comprising exciting the feed gas with a light such as laser or ultraviolet light, and (5) a method comprising combusting the feed gas. Any of these methods can achieve the good effects of the present invention.

A hydrogen gas, a carbon-containing compound and a dopant are used as the feed gas. An oxygen-containing compound or an inert gas may be optionally used.

Examples of the carbon-containing compound are a paraffinic hydrocarbon such as methane, ethane, propane and butane; an olefinic hydrocarbon such as ethylene, propylene and butylene; an acetylene hydrocarbon such as acetylene and allylene; a diolefinic hydrocarbon such as butadiene; an alicyclic hydrocarbon such as cyclopropane, cyclobutane, cyclopentane and cyclohexane; an aromatic hydrocarbon such as cyclobutadiene, benzene, toluene, xylene and naphthalene; a ketone such as acetone, diethylketone and benzophenone; an alcohol such as methanol and ethanol; an amine such as trimethylamine and triethylamine; and carbon dioxide and carbon monoxide. They may be used independently or as a mixture of at least two of them. The carbon-containing compound may be a material consisting of carbon atoms such as graphite, coal and coke.

Examples of the oxygen-containing compound are oxygen, water, carbon monoxide, carbon dioxide and hydrogen peroxide.

Example of the inert gas are argon, helium, neon, krypton, xenon and radon.

As the dopant, is used a single substance or a compound containing boron, lithium, nitrogen, phosphorus, sulfur, chlorine, arsenic or selenium. By incorporating the dopant in the feed gas, the impurity can be easily doped in the growing diamond crystal and the resistance of the diamond film can be controlled. When the impurity is not doped, or when the doping conditions are selected, an insulative diamond film can be formed.

The diamond film may be a single layer or a laminated layer. The single layer diamond film is a single layer semiconductive diamond film constituting the temperature sensing part. The laminated diamond film is, for example, a laminated layer of the semiconductive diamond film for the temperature sensing part and the insulative diamond film for at least a part of substrate. For example, the diamond film is the two layer diamond film in which the upper layer is the diamond film having the semiconductive electrical property formed by doping boron (B) and the lower layer is the insulative diamond film which has at least two order higher resistance than that of the upper layer. A total thickness of the semiconductive diamond film and the insulative diamond film is from 50 μm to 1 mm in view of the strength. Since it is preferable that the volume of the thermistor is small so as to increase the thermal response speed, the thickness of the diamond is preferably from 50 to 300 μm. The smaller the area of the diamond film is, the higher the thermal response speed is. But the formation of the electrode, the adhesion of the lead wire, and the formation of the protective film are difficult when the surface area is too small. Therefore, the diamond film preferably has an area of 0.2 mm×0.3 mm to 1.5 mm×3.0 mm.

As the substrate for growing the diamond film, are exemplified a single substance of B, Al, Si, Ti, V, Zr, Nb, Mo, Hf, Ta and W, and their oxide, carbide, nitride, boride and carbonitride. The substrate for growing the diamond film is preferably metal or Si since it can be easily removed after growing the diamond film. The diamond film which is separately formed by the vapor phase deposition can be used as the substrate for growing the diamond.

When the diamond film has at least two layers, the diamond film is prepared by successively changing the conditions. If the diamond film is grown in the finally desired shape, the desired shape is obtained and the post-processing of the diamond film is not necessary after the substrate for growing the diamond film is removed. The diamond film formed by the vapor phase deposition can be formed in plural layers and desired shape on the same substrate for growing the diamond film and this decreases the cost.

After growing the semiconductive diamond film for the temperature sensing part, the ohmic electrode is formed on the semiconductive diamond film, and then optionally the protective film comprising the insulative oxide and the like is formed. After the formation of the diamond film or ohmic electrode or the protective film, at least a part of the substrate for growing the diamond film may be removed. Since the thermal response is fast when the diamond film has larger volume ratio in the temperature detective part, the removal amount of the substrate for growing the diamond film is preferably large. It is most preferable to remove the whole of the substrate for growing the diamond film.

When the substrate for growing the diamond film is made of Si or the metal, it can be easily dissolved with an acid and the like. When the substrate cannot be easily dissolved, it may be ground, or separated from the diamond film by the thermal bombardment and the like. When plural diamond films laterally separated are simultaneously formed on one substrate for growing the diamond film, the substrate for growing the diamond film is removed preferably after simultaneously forming the electrodes and the protective films on the plural diamond films. When the whole of the substrate for growing the diamond film is removed immediately after growth of the diamond film, the ohmic electrodes and protective films are formed on the separated diamond films.

After the ohmic electrode and then optional protective film are formed on the semiconductive diamond film having the desired resistivity, the thermistor of the present invention can be prepared by adhering the lead wire to the electrode with a silver solder and the like and optionally covering the thermistor with an insulative oxide.

A total volume of the electrode and the protective film comprising the insulative oxide and the like is preferably smaller because of fast thermal response of the thermistor. The coating material and the material used for adhering the lead wire preferably have smaller volume. When the coating is not absolutely necessary, it is preferable to exclude the coating.

The diamond film formed by the vapor phase deposition occupies at least 50%, preferably at least 95% of the total volume of the temperature sensing part, the electrode layer, the optional substrate, the optional protective film, the optional coating material and the optional adhesive for lead wire which constitute the temperature detecting part. When the diamond film does not occupy at least 50% by volume, materials which have lower thermal conductance become dominant and thermal response is as slow as the conventional thermistor.

The thermistor of the present invention has fast thermal response, since a large part of its volume consist of diamond which has the largest thermal conductivity among all substances and low specific heat. The smaller the volume of the thermistor is, the faster the thermal response is, and the thermistor of the present invention can be easily miniaturized since it can be prepared by the thin film process.

Diamond is stable up to 600° C. in the air, and it is stable at 800° C. when it is shielded from the air by passivation. It stably exhibits the linear thermistor property (resistance-temperature property) in a wide temperature range of −50° C. to 600° C. or higher. The thermistor of the present invention can be used in the temperature range of −50° C. to 600° C. or higher and has faster temperature response than the conventional thermistors.

PREFERRED EMBODIMENTS OF THE INVENTION

FIG. 1 is a cross-sectional view of one embodiment of a thermistor according to the present invention. This thermistor has an insulative diamond film 11, a semiconductive diamond film 12, ohmic electrodes 13, lead wires 14 and an insulative protective film 15.

Figure 2:
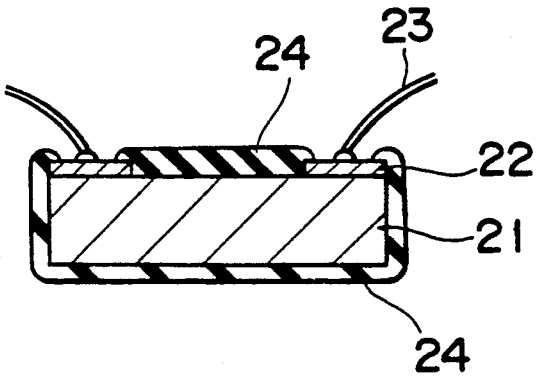

FIG. 2 is a cross-sectional view of another embodiment of a thermistor according to the present invention. This thermistor has a semiconductive diamond film 21, ohmic electrodes 22, lead wires 23 and an insulative protective film 24.

Figure 3:
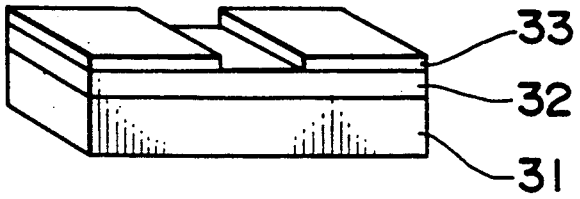
FIG. 3 is a perspective view of a thermistor which is the same as FIG. 1 except that an insulative protective film and lead wires are not formed.

FIG. 3 is a perspective view of a thermistor which is the same as that of FIG. 1 except that the insulative protective film and the lead wires are not formed. This thermistor has an insulative diamond film 31, a semiconductive diamond film 32 and ohmic electrodes 33. The ohmic electrodes 33 have, for example, a three layer structure of Au/Mo/Ti (from the top to the bottom).

Figure 4:
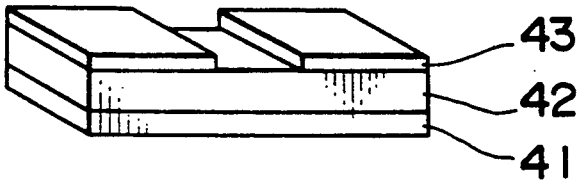
FIG. 4 and FIG. 5 are perspective views of the embodiments of a thermistor of the present invention having a substrate.

FIG. 4 is a perspective view of one embodiment of a thermistor according to the present invention which has a substrate. This thermistor has the substrate 41, a semiconductive diamond film 42 and ohmic electrodes 43. The substrate 41 is made of, for example, $Si_3N_4$.

Figure 5:
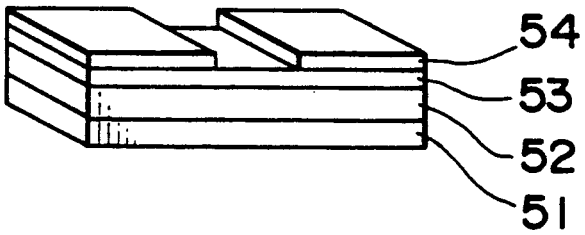

FIG. 5 is a perspective view of another embodiment of a thermistor according to the present invention which has a substrate. This thermistor has the substrate for growing the diamond film 51, an insulative diamond film 52, a semiconductive diamond film 53 and ohmic electrodes 54.

The present invention is illustrated by following Examples. Examples 1, 4 and 5 are the Examples of the present invention and Examples 2 and 3 are the Comparative Examples.

EXAMPLE 1

After scratching a Si substrate having a size of 2 cm×2 cm×250 μm with diamond powder, a polycrystal diamond film with a thickness of 250 μm was grown on the substrate by a microwave plasma CVD method (feed gas: $CH_4/H_2$ =1%, reaction pressure: 40 torr, microwave power: 400 W). Then a boron-doped polycrystal diamond film with a thickness of 3 μm was grown on the polycrystal diamond film by the microwave plasma CVD method (feed gas: $CH_4/H_2$=1%, $B_2H_6/CH_4$=200 ppm, reaction pressure: 40 torr, microwave power: 400 W). Thirty diamond films each having an area of 1.5 mm×3 mm were grown on the Si substrate by using a Mo mask during the growth.

Then, a Ti layer, a Mo layer and an Au layer were deposited in this order by electron beam deposition to form ohmic electrodes. After the whole of the electrode surface was protected by coating a resist, the whole of the Si substrate was removed by etching with fluoronitric acid. The resist was removed with acetone to obtain thirty thermistor bodies shown in FIG. 3. The insulative diamond film had a thickness of 250 μm, the B-doped semiconductive diamond film had a thickness of 3 μm, and the ohmic electrode had a thickness of 2 μm. A ratio of the diamond films in the temperature detecting part, namely a ratio:

$$\frac{\text{Volume of diamond film}}{\text{Total volume of diamond film and electrode}}$$

was 99%. Ni lead wires were adhered to the electrodes with a high temperature silver paste so as to finish thermistors. With these thermistor, a thermal time constant (a time in which thermistor reaches 63% of the temperature difference) from 20° C. to 100° C. was measured. Result is shown in Table.

EXAMPLE 2

In the same manner as in Example 1 except that the insulative diamond film was not formed, a boron-doped semiconductive diamond film was grown on a $Si_3N_4$ ceramic substrate with a size of 1.5 mm×3 mm×250 μm and ohmic electrodes were formed to prepare a thermistor shown in FIG. 4. The $Si_3N_4$ ceramic substrate had a thickness of 250 μm, the boron-doped semiconductive diamond film had a thickness of 3 μm, and the Au/Mo/Ti ohmic electrodes had a thickness of 2 μm.

$$\frac{\text{Volume of diamond film}}{\text{Total volume of substrate, diamond film and electrode}}$$

was 1%. In the same manner as in Example 1, Ni lead wires were adhered to the electrodes so as to finish thermistors. Then, a thermal time constant was determined. Result is shown in Table.

EXAMPLES 3 to 5

In the same manner as in Example 1, a none-doped diamond film and a boron-doped diamond film were grown and then ohmic electrodes were formed on a $Si_3N_4$ ceramic substrate with a size of 1.5 mm×3 mm×250 μm.

The structure shown in FIG. 5 was formed by grinding a part of the $Si_3N_4$ substrate from the bottom. The $Si_3N_4$ substrate had a thickness of 150 μm (Example 3), 125 μm (Example 4) and 100 μm (Example 5), the none-doped diamond film had a thickness of 100 μm (Example 3), 125 μm (Example 4) and 150 μm (Example 5), and the boron-doped diamond film had a thickness of 3 μm (Examples 3 to 5).

$$\frac{\text{Volume of diamond film}}{\text{Total volume of substrate, diamond film and electrode}}$$

was 40% (Example 3), 50% (Example 4) and 60% (Example 5). In the same manner as in Example 1, Ni lead wires were adhered to the electrodes so as to finish thermistors. The thermal time constants were determined. Results are shown in Table.

TABLE

| Example No. | Ratio* | Thermal time constant (sec.) |
|---|---|---|
| 1 | 99% | 0.53 |
| 2 | 1% | 1.10 |
| 3 | 40% | 1.10 |
| 4 | 50% | 0.98 |

TABLE-continued

| Example No. | Ratio* | Thermal time constant (sec.) |
|---|---|---|
| 5 | 60% | 0.88 |

Note:

$$*\text{Ratio} = \frac{\text{Volume of diamond film}}{\text{Total Volume of substrate, diamond film and electrode}}$$

When the volume ratio of he diamond film is at least 50%, the thermal time constant is smaller than 1.0 second, and the thermistor of the present invention has fast thermal response.

What is claimed is:

1. A thermistor comprising a temperature detecting part that includes:

a temperature sensing part made of a vapor phase deposited semiconductive diamond film;

a metal electrode layer formed on one surface of the semiconductive diamond film;

at least one lead wire connected with he metal electrode layer; and a substrate containing an insulative diamond film on a second surface of the semiconductive diamond film;

wherein the vapor phase deposited diamond constitutes at least 50% of a total volume o the temperature sensing part, the metal electrode layer and the substrate.

2. The thermistor according to claim 1, wherein the temperature detecting part further comprises at least one element selected from the group consisting of a substrate on the other surface of the semiconductive diamond film, a protective film for protecting the semiconductive diamond film, a covering material for covering the thermistor, and an adhesive for connecting the lead wire with the electrode layer and wherein 100% by volume of the temperature sensing part, 0 to 100% by volume of the substrate and 0 to 100% by volume of the protective film are made of the vapor phase deposited diamond provided that at least 50% of a total volume of the temperature sensing part, the metal electrode layer, the substrate, the protective film, the covering material and the adhesive consists of the vapor phase deposited diamond.

3. The thermistor according to claim 1, wherein at least 95% of the total volume of the temperature sensing part and the metal electrode layer consists of the vapor phase deposited diamond.

4. The thermistor according to claim 1, wherein the insulative diamond film has at least two order higher resistance than that of the semiconductive diamond film.

5. The thermistor according to claim 1, a total thickness of the semiconductive diamond film and the insulative diamond film is from 50 μm to 1 mm.

6. The thermistor according to claim 1, wherein the diamond film has an area of 0.2 mm×0.3 mm to 1.5 mm×3.0 mm.

7. The thermistor according to claim 1, wherein the semiconductive diamond film contains at least one dopant selected from the group consisting of boron, lithium, nitrogen, phosphorus, sulfur, chlorine, arsenic and selenium.

8. A method of preparing the thermistor of claim 1, which comprises forming a diamond film on a substrate other than diamond by a vapor phase deposition, then removing at least a part of the substrate.

9. The method according to claim 8, wherein the substrate is made of at least one material selected from the group consisting of a single substance of B, Al, Si, Ti, V, Zr, Nb, Mo, Hf, Ta and W, and their oxide, carbide, nitride, boride and carbonitride.

* * * * *